US009435235B2

(12) United States Patent
Pegg et al.

(10) Patent No.: US 9,435,235 B2
(45) Date of Patent: Sep. 6, 2016

(54) ENGINE OIL SUPPLY SYSTEM AND A METHOD OF CONTROLLING AN ENGINE OIL SUPPLY SYSTEM

(71) Applicant: Ford Global Technologies, LLC, Dearborn, MI (US)

(72) Inventors: Ian Graham Pegg, Chelmsford (GB); Timothy James Bowman, Bexley (GB)

(73) Assignee: Ford Global Technologies, LLC, Dearborn, MI (US)

( * ) Notice: Subject to any disclaimer, the term of this patent is extended or adjusted under 35 U.S.C. 154(b) by 231 days.

(21) Appl. No.: 14/268,692

(22) Filed: May 2, 2014

(65) Prior Publication Data

US 2014/0352652 A1 Dec. 4, 2014

(30) Foreign Application Priority Data

Jun. 4, 2013 (GB) ..... 1309954.4

(51) Int. Cl.
*F01M 1/16* (2006.01)
*F01M 5/02* (2006.01)

(52) U.S. Cl.
CPC ..... *F01M 1/16* (2013.01); *F01M 5/025* (2013.01); *F01M 2005/028* (2013.01)

(58) Field of Classification Search
CPC ..... F01M 1/16; F01M 5/025
USPC ..... 123/196 R
See application file for complete search history.

(56) References Cited

U.S. PATENT DOCUMENTS

| | | | | |
|---|---|---|---|---|
| 8,346,459 | B2 | 1/2013 | Kuah | |
| 2010/0292850 | A1* | 11/2010 | Kuah | F01M 1/16 700/282 |
| 2012/0204822 | A1 | 8/2012 | Weber | |

FOREIGN PATENT DOCUMENTS

| | | | |
|---|---|---|---|
| EP | 1586750 | A1 | 10/2005 |
| GB | 2472812 | A | 2/2011 |
| JP | H04238739 | A | 8/1992 |

* cited by examiner

*Primary Examiner* — Lindsay Low
*Assistant Examiner* — Kevin Lathers
(74) *Attorney, Agent, or Firm* — Julia Voutyras; Alleman Hall McCoy Russell & Tuttle LLP

(57) ABSTRACT

An engine oil supply system for a motor vehicle and a method of controlling an engine oil supply system of a motor vehicle is disclosed in which, particularly during an engine overrun period or an engine shut-down, kinetic energy from the slowing engine is used to drive an oil pump so as to store oil in an oil accumulator for later use by one or more engine components without the engine using fuel. The stored oil allows a downsized oil pump to be used thereby saving fuel by providing a supply of oil in addition to or as an alternative to the oil supplied from the oil pump.

12 Claims, 5 Drawing Sheets

ENGINE OIL SUPPLY SYSTEM AND A METHOD OF CONTROLLING AN ENGINE OIL SUPPLY SYSTEM

CROSS REFERENCE TO RELATED APPLICATIONS

The present application claims priority to G.B. Patent Application No. 1309954.4, filed Jun. 4, 2013, the entire contents of which are hereby incorporated by reference for all purposes.

BACKGROUND\SUMMARY

Vehicles may use an oil delivery system to lubricate and/or cool various components of an internal combustion engine. An oil pump is included to deliver the oil. The sizing of an oil pump is done to meet peak demand and worst case conditions, which often results in the size of the oil pump being larger than is required for normal operation. A larger than required oil pump to meet normal demand also uses extra fuel because a larger oil pump will generate greater losses. It is therefore desirable to size the oil pump as close as possible to the expected normal requirement.

One approach to sizing the oil pump to the expected normal requirement is shown in EP 1586750. Here, an oil accumulator for an oil supply circuit of an engine is provided, which allows for the size of an oil pump to be smaller.

A potential issue noted by the inventors with the above approach is that there is no control of the flow of oil into and out of the accumulator, which may not reduce fuel usage.

One potential approach to at least partially address some of the above issues relates to an engine oil supply system having an engine drive oil pump to provide a supply of oil at pressure to an oil supply circuit and an oil accumulator which is connected to the oil supply circuit by means of an electronically controlled valve. An electronic controller is arranged to receive an input indicative of at least one engine operating condition and to control the operation of the electronically controlled valve based at least partly upon the at least one engine operating condition. A first pressure sensor to sense the pressure of the oil in the oil supply circuit and supply an output indicative of the sensed oil pressure to the electronic controller and a second oil pressure sensor to sense the pressure of the oil in the oil accumulator and supply an output indicative of the sensed pressure to the electronic controller are included. The electronic controller is operable to compare the output from the first pressure sensor with the output from the second pressure sensor and, if the sensed pressure of the oil in the oil accumulator is lower than the sensed pressure of the oil in the oil supply circuit and a predefined engine operating condition indicating that charging of the oil accumulator with oil will incur substantially no fuel usage by the engine is present, operate the electronically controlled valve to connect the oil accumulator to the oil supply circuit so as to charge the oil accumulator with oil at pressure. The electronically controlled valve allows for the oil supply circuit to be connected or disconnected to the oil accumulator and allows for the oil accumulator to be connected to a demand for oil, overall reducing the oil pump size and using substantially no fuel to charge the oil accumulator.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
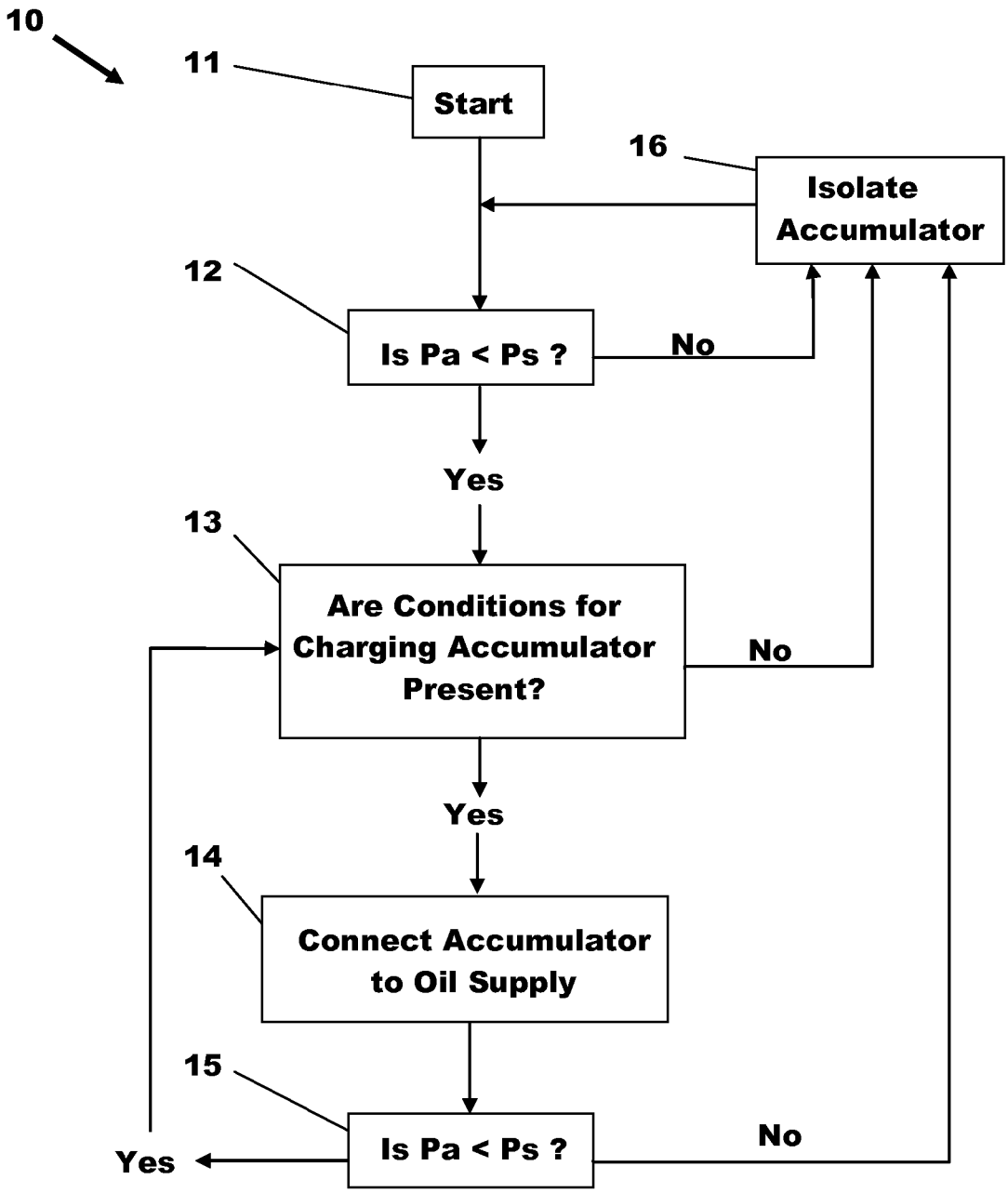
FIG. 1 is a high level flowchart showing a first part of a method of controlling an engine oil supply system in accordance with a third aspect of the present application.
Figure 2:
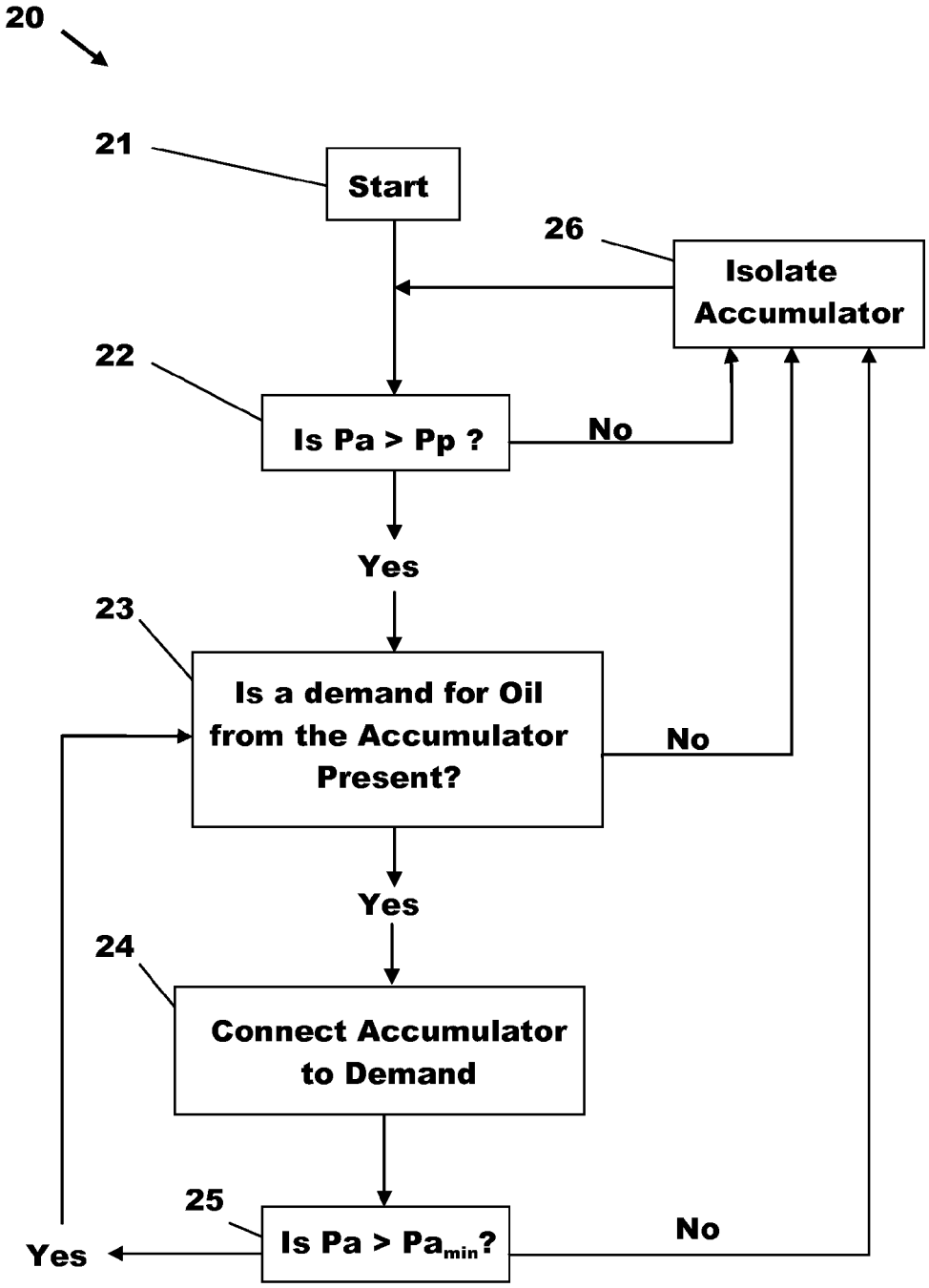
FIG. 2 is a high level flowchart showing a second part of a method of controlling an engine oil supply system in accordance with the third aspect of the present application.
Figure 3:
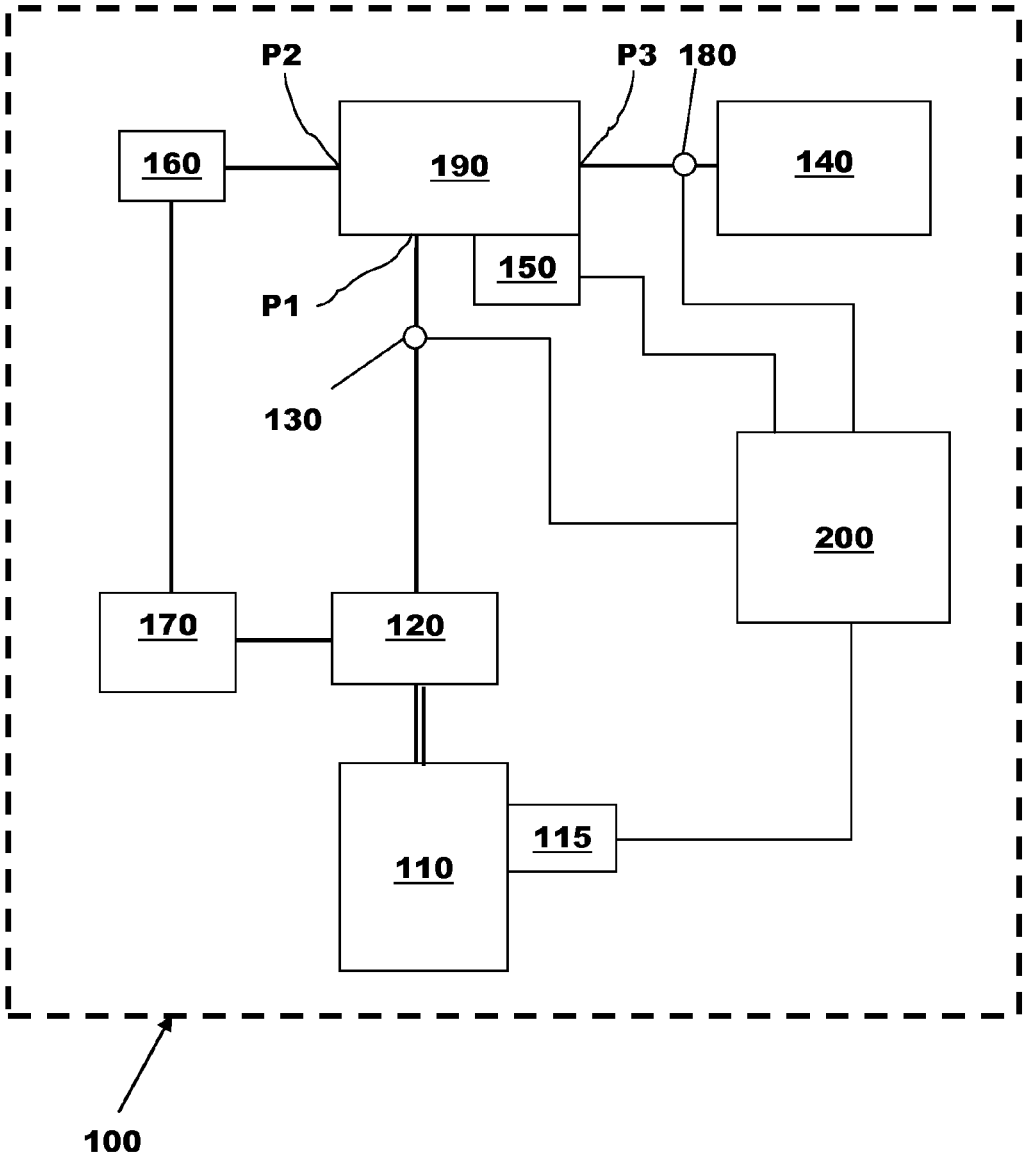
FIG. 3 is a schematic representation of a motor vehicle according to a second aspect of the present application having an engine oil supply system according to a first aspect of the present application.

The present disclosure relates to methods and systems to control the engine oil supply system of a motor vehicle. An oil accumulator is connected with an oil supply circuit, as shown in FIG. 3, and a method to charge and discharge the oil accumulator to reduce fuel usage of the engine is illustrated in FIGS. 1 and 2. The oil accumulator is placed in one of three working positions: the first to connect the oil accumulator to the oil supply, the second to disconnect the oil accumulator to the oil supply, and the third to connect the oil accumulator to a demand as illustrated at point P1, P2 and P3 in FIGS. 3 and 4. The oil accumulator is charged based on meeting at least one condition so as to not affect fuel usage and an oil pressure in the accumulator being less than a threshold. The oil accumulator is discharged based on a demand being present, which the oil pump is not able to fulfil, and an oil pressure in the accumulator being greater than a threshold. Examples of the fill level of the oil accumulator are illustrated in FIG. 5.

This present application relates to motor vehicles and in particular to the control of an engine oil supply system of a motor vehicle.

There is increasing pressure on the manufacturers of motor vehicles to reduce fuel consumption.

One significant engine loss is the energy to drive the oil pump. With a conventional oil supply system the oil pump has to be sized to meet peak demand/worst case conditions and this often results in an oil pump of a larger size being used than is required for normal operation.

In terms of oil pump sizing one of the key design points is hot idle. In this state the oil has a low viscosity leading to low flow resistance and high flow through any parts supplied with the oil. However, because the engine is rotating slowly and the oil pump is driven by the engine, the oil pressure will drop to an unacceptable level unless the size of the oil pump is increased beyond that required for normal running to a size large enough to maintain oil pressure even during hot idle conditions. For example, in one test engine the oil pressure decreased by a factor of nearly five when the engine speed was reduced by a factor of two down to idle speed.

Using an oil pump that is larger than that required to meet normal demand will use extra fuel because a larger oil pump will generate greater parasitic losses. It is therefore desirable to size the oil pump as close as possible to the expected normal requirement and not to meet worst case conditions such as hot oil at idle speed.

It is known from EP-A-1 586 750 to provide an oil accumulator for an oil supply circuit of an engine that allows the size of an oil pump to be sized smaller than may normally be the case.

It is an object of the present application to provide an engine oil supply system and a method of controlling an engine oil supply system to reduce the fuel usage of the engine.

According to a first aspect of the present application there is provided engine oil supply system having an engine driven oil pump to provide a supply of oil at pressure to an oil supply circuit and an oil accumulator connectable to the oil supply circuit by means of an electronically controlled valve, an electronic controller arranged to receive an input indicative of at least one engine operating condition and to control the operation of the electronically controlled valve based at least partly upon the at least one engine operating condition, a first oil pressure sensor to sense the pressure of oil in the oil supply circuit and supply an output indicative of the sensed pressure to the electronic controller and a second oil pressure sensor to sense the pressure of the oil in the oil accumulator and supply an output indicative of the sensed pressure to the electronic controller, wherein the electronic controller is operable to compare the output from the first pressure sensor with the output from the second pressure sensor and, if the sensed pressure of the oil in the oil accumulator is lower than the sensed pressure of the oil in the oil supply circuit and a predefined engine operating condition indicating that charging of the oil accumulator with oil will incur substantially no fuel usage by the engine is present, operate the electronically controlled valve to connect the oil accumulator to the oil supply circuit so as to charge the oil accumulator with oil at pressure.

The predefined engine operating condition indicating that charging of the oil accumulator with oil will incur substantially no fuel usage by the engine may be one of an engine shut-down condition, an engine over-run condition and an engine operating condition in which the engine is operating at a speed where excess oil would otherwise be vented to an oil reservoir.

The first pressure sensor may be located in the oil supply circuit between an outlet from the engine driven pump and the electronically controlled valve.

The second pressure sensor may be located so as to sense the pressure of the oil substantially at a take-off point where the oil is extracted from the oil supply circuit for charging the oil accumulator.

The second pressure sensor may be located at one of a position in a supply line joining the electronically controlled valve to the accumulator, an outlet from the electronically controlled valve, an inlet to the oil accumulator and a position on the oil accumulator where the oil pressure within the oil accumulator can be directly sensed.

The electronically controlled valve may be positioned immediately downstream from and close to an outlet from the engine driven pump so as to maximise the available pressure for charging the oil accumulator.

The electronically controlled valve may be formed as an integral part of an outlet from the engine driven oil pump.

The electronically controlled valve may be placed in one of three working conditions to provide a connection between the oil accumulator and the oil supply circuit, disconnect the oil accumulator and the oil supply circuit, and connect the oil accumulator and a demand for oil.

According to a second aspect of the present application there is provided a motor vehicle having an engine oil supply system constructed in accordance with said first aspect of the present application.

According to a third aspect of the present application there is provided a method of controlling an engine oil supply system having an engine driven oil pump to provide a supply of oil at pressure to an oil supply circuit and an oil accumulator connectable to the oil supply circuit wherein the method comprises measuring the pressure of the oil in the oil supply circuit, measuring the pressure of the oil in the oil accumulator, comparing the pressure of the oil in the oil supply circuit to the pressure of oil in the oil accumulator and, if the measured pressure of the oil in the oil accumulator is lower than the measured pressure of the oil in the oil supply circuit and a predefined operating condition is present indicating that charging of the oil accumulator with oil will incur substantially no fuel usage by the engine, connecting the oil accumulator to the oil supply circuit so as to charge the oil accumulator with oil at pressure.

The engine oil supply system may include a controllable valve to selectively connect the oil accumulator to the oil supply circuit and connecting the oil accumulator to the oil supply circuit so as to charge the oil accumulator with oil at pressure may comprise opening the controllable valve to connect the oil accumulator to the oil supply circuit.

The predefined operating condition indicating that charging of the oil accumulator with oil will incur substantially no fuel usage by the engine may be one of an engine shut-down condition and an engine over-run condition.

The predefined operating condition indicating that charging of the oil accumulator with oil will incur substantially no fuel usage by the engine may be an engine operating condition in which the engine is operating at a speed where excess oil would otherwise be vented to an oil reservoir.

The method may further isolate the oil accumulator if the oil accumulator pressure is not below the oil pressure in the oil circuit or the entry condition(s) for charging the accumulator is not met.

The controllable valve may selectively disconnect the oil accumulator from the oil supply circuit to as not allow oil to the oil accumulator.

The method may further connect the oil accumulator to a demand if the oil pressure in the oil accumulator is greater than a predefined pressure and there is a demand for oil from the accumulator present.

The controllable valve may selectively connect the oil accumulator with the demand.

The present application will now be described by way of example with reference to the accompanying FIGS. 1-5.

With reference to FIGS. 1 and 2 there are shown high level flow charts of first and second parts 10 and 20 of a method of controlling an engine oil supply system of a motor vehicle according to the present application such as the engine oil supply system shown in FIGS. 3 to 5*b* which includes an oil accumulator 140. The first part 10 of the method is shown in FIG. 1 and relates to charging or filling of the oil accumulator 140 and the second part 20 of the method is shown in FIG. 2 and relates to discharging of the oil accumulator 140.

With reference to FIG. 1 the first part 10 of the method starts at box 11 which could be a manual key-on and engine start event.

The method then advances to box 12 where the pressure of the oil in the oil supply circuit is measured and the pressure of the oil in the oil accumulator are both measured and then compared to see whether the measured oil pressure in the oil accumulator is less than the measured oil pressure in the oil supply circuit pressure.

If the measured pressure in the oil accumulator is not less than the measured pressure in the oil supply circuit, the method advances to box 16 and the oil accumulator is isolated from the main oil supply circuit. The method then returns from box 16 to box 12.

However, if when checked in box 12 the measured pressure in the oil accumulator is less than the measured pressure in the oil supply circuit, the method advances to box 13 where it is checked whether the conditions for charging or filling the oil accumulator are present.

Various conditions could be checked as part of this test but the test is passed if a positive outcome will not seriously affect fuel usage. That is to say, charging the oil accumulator with oil is permitted if it will incur substantially no fuel usage.

In one embodiment, the condition checked is whether the engine is decelerating and is in what is often termed an 'over-run condition'. While in an 'over-run condition' it is common practice to cut-off the fuel supply to the engine. Therefore, if the oil accumulator is charged with oil during such a situation, no fuel is used to fill the oil accumulator.

In a second embodiment the condition checked is whether the engine is being shut-down or stopped. If the engine is being shut-down the oil accumulator can be charged with oil with no fuel being used to fill the oil accumulator because no fuel is being supplied to the engine. This technique is particularly useful if the motor vehicle to which the engine is fitted has a start stop system because it is desirable to stop the engine as quickly as possible when using such a system and the load applied by the oil pump will aid slowing of the engine particularly if the output from the oil pump is variable and can be increased during the engine shut-down.

In a third embodiment the condition checked is that the engine is operating at high speed and the oil is cold. When in such a condition there is no potential issue in generating sufficient oil pressure and it is often the case that the oil pressure is such that some pressure has to be relieved by venting of the oil back to an oil reservoir. In such a situation, charging or filling the oil accumulator with oil rather than venting the oil will have no significant adverse effect on fuel consumption.

It will be appreciated that one or more three of the aforementioned conditions could be checked for and, if any one of the conditions is present, then charging of the oil accumulator is permitted.

Referring back to box 13, if a condition for charging the oil accumulator is not present the method advances to box 16 and then back to box 12. However, if a condition for charging the oil accumulator is present, the method advances to box 14 and the oil accumulator is connected by opening a an electronically controllable valve to the oil supply circuit so that it may be charged with oil up to the pressure currently subsisting in the oil supply circuit.

The method then advances to box 15 to check whether the current measured oil pressure in an oil accumulator is less than the currently measured pressure in the oil supply circuit. If the current measured oil pressure in an oil accumulator is not less than the currently measured pressure in the oil supply circuit the method advances to box 16 and the oil accumulator is isolated from the main oil supply circuit. The method then returns from box 16 to box 12.

If however the current measured oil pressure in an oil accumulator is less than the currently measured pressure in the oil supply circuit, the method returns from box 15 to box 13 where it is re-checked whether the conditions for charging or filling the oil accumulator are present.

Therefore the method loops around boxes 13 to 15 until either the conditions for charging the oil accumulator no longer are present or the measured pressure in the oil accumulator reaches the measured pressure in the oil supply circuit.

If at any time a key-off event occurs, the method will end.

The take-off point in the oil supply circuit where the supply of oil for the oil accumulator is taken from is preferably close to an outlet from an engine driven oil pump used to circulate oil through the oil supply circuit so as to minimise any circuit losses. In particular, the take-off point is upstream from any engine components utilising the oil supply from the engine driven oil pump.

With reference to FIG. 2 the second part 20 of the method starts at box 21 which could be a manual key-on and engine start event.

The method then advances to box 22 where it is checked whether the measured pressure of the oil in the oil accumulator is greater than a predefined pressure Pp. The pressure Pp is a pressure that indicates that there is a significant volume of oil stored in the oil accumulator. That is to say, the oil accumulator is nearly full. If the measured pressure of the oil in the oil accumulator is not greater than Pp, the method advances to box 26 and the oil accumulator is isolated or remains isolated from the main oil supply circuit. The method then returns from box 26 to box 22. However, if the measured pressure of the oil in the oil accumulator is greater than the predefined pressure Pp, the method advances to box 23 where it is checked whether there is a demand for oil from the oil accumulator.

Various demands could be met from the oil accumulator, for example, a cam phaser actuator could be supplied with oil or piston cooling jets could be supplied with oil. In one particularly advantageous embodiment applicable to a motor vehicle having a stop-start system, when an automated start takes place, oil is supplied to the bearings of the engine and any other system requiring oil not from the oil pump but from the oil accumulator and the oil pump demand is set to zero. This has the effect of reducing the energy to start the engine and also reduces starting device wear. Also because the torque to drive the oil pump is reduced to substantially zero it will reduce engine fuel consumption because less energy will have to be used subsequently by the engine to replace the energy used to start the engine.

Referring back to box 23, if there is no demand for oil from the oil accumulator, the method advances to box 26 where the oil accumulator remains isolated or is isolated if not already in that state and then returns back to box 22. However, if there is a demand for oil from the oil accumulator, the method advances to box 24 and the oil accumulator is connected to the oil supply circuit so that it may supply oil to the component or components requiring a supply of oil.

In some embodiments the oil accumulator may not be connected via the oil supply circuit to supply the oil to the component it may be directly connected to the component requiring the supply of oil. For example, the oil accumulator may be connected directly to a cam phaser actuator while remaining isolated from the oil supply circuit which is fed from the engine driven oil pump. In such a situation the pressure of the oil supplied to the cam phaser actuator may be higher than that currently subsisting in the oil supply circuit.

The method then advances to box 25 to check whether the measured pressure (Pa) of the oil in the oil accumulator is greater than a predefined minimum accumulator pressure ($Pa_{min}$). This predefined minimum accumulator pressure ($Pa_{min}$) is a pressure that indicates that the oil accumulator is nearly empty and can no longer be used to supply oil to other components of the engine.

If the current measured pressure (Pa) of the oil in the oil accumulator is less than the accumulator minimum pressure ($Pa_{min}$) then the method advances to box 26 and the oil accumulator is isolated from the main oil supply circuit. The method then returns from box 26 to box 22.

If however, the measured pressure (Pa) of the oil in the oil accumulator is greater than the accumulator minimum pressure ($Pa_{min}$) when checked in box 25, the method returns to box 23 where it is re-checked whether a demand for oil from the oil accumulator is still present. Therefore the method loops around boxes 23 to 25 until either there is no longer a demand for oil from the oil accumulator or the measured pressure (Pa) of the oil in the oil accumulator falls below or is equal to the accumulator minimum pressure ($Pa_{min}$).

If at any time a key-off event occurs, the method will end.

With reference to FIGS. 3 to 5*b* there is shown an engine oil supply system which forms part of a motor vehicle 100.

The engine oil supply system comprises an oil pump 120 driven by an engine 110, an electronically controlled valve 190, a component 160 requiring a supply of oil, an oil reservoir 170, an oil supply circuit linking the engine driven pump 120 to the electronically controlled valve 190 and the component 160, an oil accumulator 140 selectively connectable to the oil supply circuit by means of the electronically controlled valve 190 and an electronic controller 200 to control the operation of the electronically controlled valve 190 by means of an actuator 150.

The engine oil supply system further comprises a first oil pressure sensor 130 to sense the pressure of oil in the oil supply circuit and supply an output indicative of the sensed pressure to the electronic controller 200 and a second oil pressure sensor 180 to sense the pressure of the oil in the oil accumulator and supply an output indicative of the sensed pressure to the electronic controller 200.

The electronic controller 200 is also arranged to receive from one or more sensors 115 associated with the engine 110 information regarding the operating condition of the engine 110.

The electronically controlled valve 190 is connected to an output from the engine driven oil pump 120 so as to receive a flow of oil at pressure therefrom. Although the electronically controlled valve 190 is shown as being a distinct component it will be appreciated that it could be formed as an integral part of an outlet from the engine driven oil pump 120.

Figure 4A:
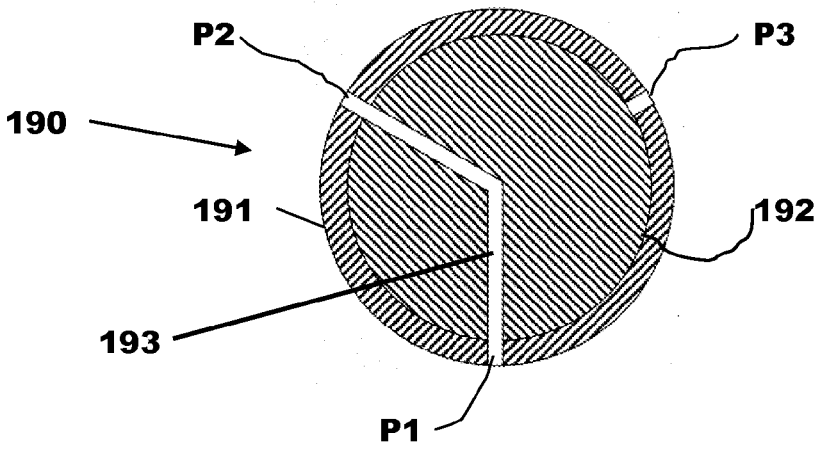
FIGS. 4*a* to 4*c* are diagrammatic representations of an electronically controlled valve forming part of an engine oil supply system showing the valve in three different flow path states.
Figure 4B:
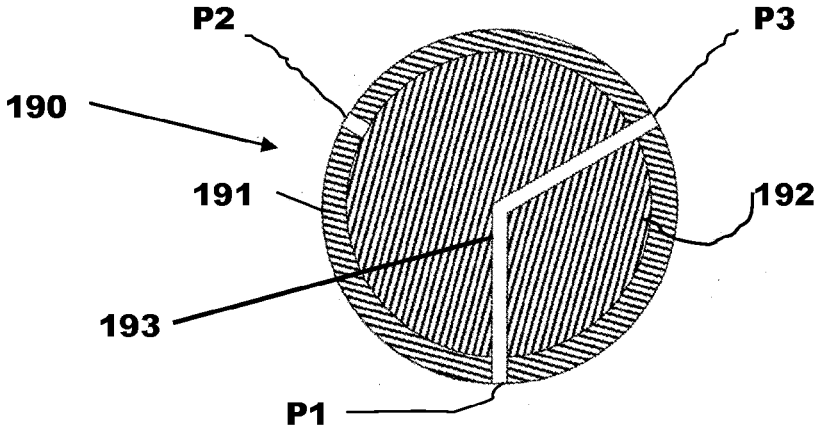
Figure 4C:
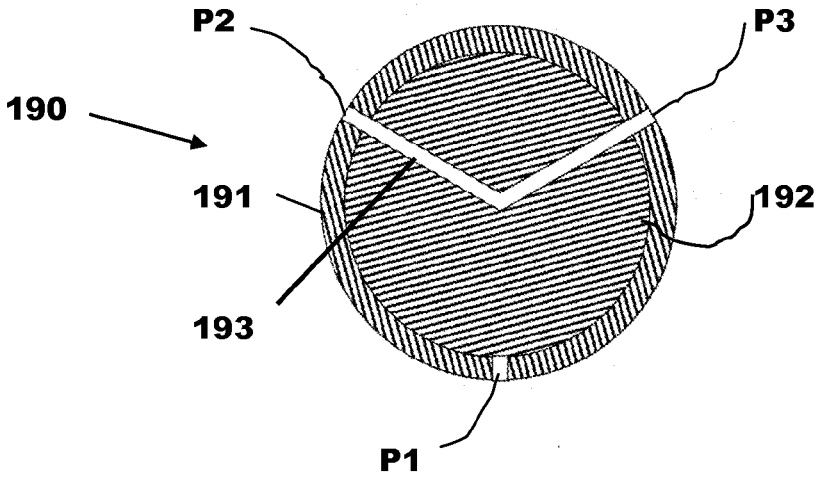

The electronically controlled valve 190 is best understood with reference to FIGS. 4*a* to 4*c* and has in the case of this example three selectable oil flow paths.

The electronically controlled valve 190 has a body 191 in which is rotatably mounted a valve member 192 defining an oil flow passage 193. The body 191 has first port P1 connected to the engine driven oil pump 120, a second port P2 connected to the component 160 requiring a supply of oil and a third port P3 connected to the oil accumulator 140.

The electronically controlled valve 190 is interposed between the engine driven oil pump 120 and the component 160 requiring a supply of oil, between the engine driven oil pump 120 and the oil accumulator 140 and between the oil accumulator 140 and the component 160 requiring a supply of oil. The component 160 requiring a source of oil could be, for example, a cam phaser actuator, one or more bearings of the engine 110 or piston cooling jets of the engine 110. The electronically controlled valve 190 could be formed as an integral part of the engine driven oil pump 120 as part of an outlet from the engine driven oil pump 120. In which case the first oil pressure sensor 130 may be arranged to sense the pressure of the oil exiting the oil pump 120 before it enters the electronically controlled valve 190.

In FIG. 4*a* the valve member 192 is shown in a position in which the oil flow passage 193 defines a first flow path connecting the engine driven oil pump 120 to the component 160.

In FIG. 4*b* the valve member 192 is shown in a position in which the oil flow passage 193 defines a second flow path connecting the engine driven oil pump 120 to the oil accumulator 140.

In FIG. 4*c* the valve member 192 is shown in a position in which the oil flow passage 193 defines a third flow path connecting the oil accumulator 140 to the component 160.

The valve member 192 is rotatable by the electric actuator 150 in response to a control input from the electronic controller 200 so that the selection of flow path is controlled by the electronic controller 200.

It will be appreciated that alternative forms of three way valve could be constructed and that the present application is not limited to the rotary valve 190 shown in FIGS. 4*a* to 4*c* or to the use of a single valve.

Figure 5A:
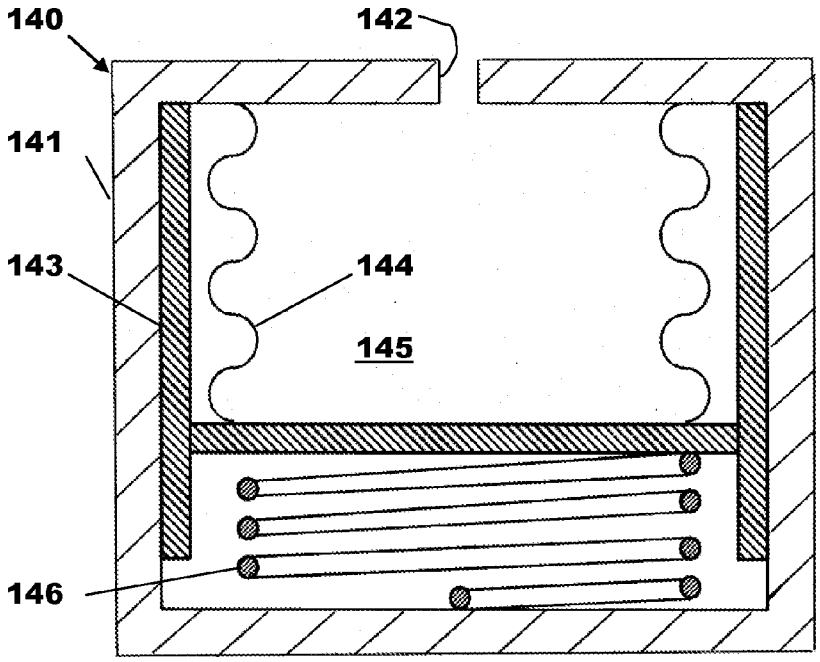
FIGS. 5*a* and 5*b* are diagrammatic cross-sectional representations of an oil accumulator suitable for use in an engine oil supply system constructed in accordance with said first aspect of the present application.
Figure 5B:
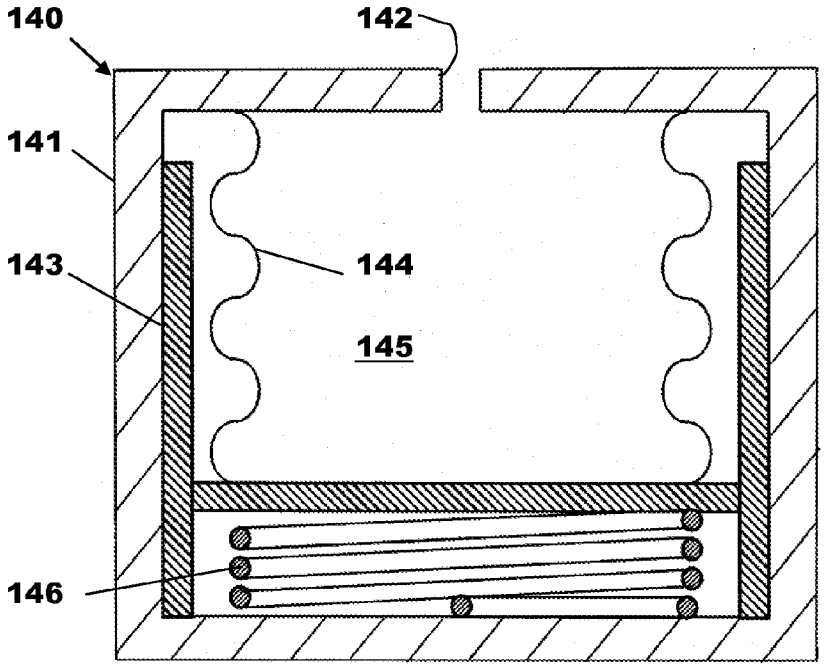

The oil accumulator 140 can be of any suitable construction and may not be of a sealed bellows type such as that shown in FIGS. 5*a* and 5*b*.

The oil accumulator 140 is shown in FIG. 5*a* in an empty state and in FIG. 5*b* in a full state. The oil accumulator comprises a body 141 defining a flow passage 142 by which oil can enter or leave a storage volume 145 defined by a cup shaped piston, a metal bellows 144 and the body 141. The piston 143 supports the bellows 144 and is slidingly supported by the body 141. A spring 146 biases the piston 143 towards the end of the body 141 at which oil enters or leaves the storage volume 145 via the flow passage 142. The bellows 144 is sealed to both the body 141 and the piston 143 and so there is no possibility of leakage of oil. It will be appreciated that in practice the body 141 will not be a single component but will be constructed to enable assembly of the various oil accumulator components 143, 144, 146.

Although the pressure of the oil is shown in FIG. 3 to be sensed by a second oil pressure sensor 180 located in a supply line joining the oil accumulator 140 to the electronically controlled valve 190 and so is positioned outside of the oil accumulator 140 it will be appreciated that the oil pressure within the storage volume 145 could be directly sensed by a pressure sensor located at an inlet to the oil accumulator 140 or a pressure sensor located at position on the oil accumulator 140 where the oil pressure within the oil accumulator 140 can be directly sensed. In addition, the pressure of the oil in the oil accumulator 140 could be measured by measuring the position of the piston 143 and inferring from the position of the piston the pressure of the oil in the storage volume 145 or by measuring the oil pressure using a sensor located at an outlet from the electronically controlled valve 190.

During normal use the valve member 192 of the electronically controlled valve 190 is in the position shown in FIG. 4*a* and the engine driven oil pump 120 draws oil from the oil reservoir 170 and produces a supply of pressurised oil that is circulated through the oil supply circuit to the component 160. Oil is then returned from the component 160 to the oil reservoir 170. In this rotational position the valve member 192 isolates the oil accumulator 140 from the engine driven oil pump 120 and also from the component 160.

The electronic controller 200 continuously monitors the operating condition of the engine 110 via the sensors 115 and also the pressure of the oil both in the oil supply circuit and in the oil accumulator 140 via the first and second oil pressure sensors 130 and 180.

Preferably, the accumulator 140 is located close to the component 160 requiring a supply of oil in order to reduce losses. In addition, the electronically controlled valve 190 is located close to the outlet from the engine driven oil pump 120 so as to minimise pressure losses and thereby maximise the oil pressure at a take-off point defined by the electronically controlled valve 190 from which oil can be extracted to charge or fill the oil accumulator 140.

The first oil sensor 130 is preferably located as close as possible to the oil take-off point (the electronically controlled valve 190) but in any event is located downstream from the outlet of the engine driven oil pump 120 at a position before the component 160.

The positioning of the first oil pressure sensor 130 is important because it is used as a control input for the electronic controller 200.

When the electronic controller 200 senses that a predefined set of conditions are present the valve actuator 150 is operated, adjusting the valve member 192 to the first position shown in FIG. 4*b*. In the valve first position shown in FIG. 4*b*, oil can flow from the oil supply circuit into the oil accumulator 140 so as to charge the oil accumulator 140 with oil at the same pressure currently subsisting in the oil supply circuit.

If the predefined set of conditions are not present and there is no demand for oil from the component 160 the valve member 192 will remain in the isolating second positioning shown in FIG. 4*a*.

The predefined set of conditions comprise of an oil pressure difference condition and an engine operating condition.

The oil pressure difference condition for charging of the oil accumulator 140 to occur is that the measured or inferred pressure in the oil accumulator 140 must be less than the measured pressure of the oil in the oil supply circuit at the take-off point. That is to say, Pa must be less than Ps where Pa is the measured or inferred pressure of the oil in the oil accumulator 140 and Ps is the pressure of the oil in the oil supply circuit at the take-off point. This condition is checked by the electronic controller 200 by comparing the outputs from the first and second oil pressure sensors 130 and 180. It will be appreciated that if this pressure difference is not present then oil could not flow into the oil accumulator 140 from the oil supply circuit.

While the valve member 192 remains in the second position shown in FIG. 4*b* the oil accumulator 140 is isolated from the component 160 but is connected to the engine driven oil pump 120. Although not visible in FIGS. 4*a* to 4*c* a further oil flow path exists to allow some of the oil to bypass the electronically controller valve 190 when the valve member 192 is in the position shown in FIG. 4*b* to keep the component 160 from being starved of oil.

If the oil pressure differential condition is met then the electronic controller checks using the sensors 115 whether a predefined engine operating condition is present to confirm that charging of the oil accumulator 140 can take place. There could be several engine operating conditions, wherein one or more may be present. The engine operating condition is an engine operating condition in which the oil accumulator 140 can be charged with oil without the engine 110 using any significant amount of fuel. That is to say, the engine operating condition enables the oil accumulator 140 to be charged with oil with no appreciable fuel penalty.

A first suitable engine operating condition is an engine 'over-run condition' in which the engine 110 is decelerating with no fuel being supplied. If the oil accumulator 140 is charged with oil during such a situation, no fuel is used to charge or fill the oil accumulator 140.

A second suitable engine operating condition is an engine 'shut-down' or stopping condition. If the engine is being shut-down or stopped no fuel is supplied to the engine 110 and so the oil accumulator 140 can be charged with oil with no fuel penalty. This technique is particularly useful if the motor vehicle to which the engine 110 is fitted has a start stop system because it is desirable to stop the engine 110 as quickly as possible when using such a system in order to improve economy and emissions. The load applied to the engine 110 from the oil pump 120 will aid slowing of the engine 110 particularly if the output from the engine driven oil pump 120 is variable and can be increased during the engine shut-down.

A third suitable engine operating condition is when the engine is operating a moderate to high speed and the oil is cold. When the engine 110 is operating in such conditions there is no potential issue in generating sufficient oil pressure because the oil is very viscous and it is often the case that the oil pressure is high, so some of the pressure has to be relieved by venting of the oil back to the oil reservoir 170. In such a situation charging or filling the oil accumulator 140 with oil rather than venting the oil has no adverse effect on fuel usage by the engine 110. This situation could be sensed using the first oil sensor 130. The pressure at which venting of the oil occurs may be known and so when the pressure of the oil in the oil supply circuit approaches such a pressure oil can be used to charge the accumulator 140 with no appreciable fuel penalty.

It will be appreciated that more than one of these engine operating condition could be checked and provided that at least one engine operating condition is found to be present then charging of the accumulator 140 is permitted.

Charging or filling of the oil accumulator 140 with oil will continue until either the pressure in the oil accumulator 140 reaches that in the oil supply circuit at the take-off point or the engine operating condition is no longer present. In either case the oil accumulator 140 is then isolated from the engine driven oil pump 120 by moving the valve member 192 of the electronically controlled valve 190 to the position shown in FIG. 4*a*.

The electronic controller 200 is further operable to control the electronically operable valve 190 to move the valve member 192 to the third position shown in FIG. 4*c* if a demand for oil is present for the component 160 and there is sufficient oil stored in the oil accumulator 140 as judged by comparing the measure or inferred pressure of oil in the oil accumulator with a predefined pressure Pp. The demand for oil is a demand that cannot be met at that point in time by use of the engine driven oil pump 120.

For example, if the engine 110 is idling and the oil is hot, then the available oil pressure may be below a lower pressure threshold at which the component can operate satisfactorily. This is because the engine driven oil pump 120 is sized in the case of this application not to satisfy a worst case situation but to enable oil to be supplied at within a pressure range when the engine 110 is operating in a normal operating range. By sizing the engine driven oil pump 120 in this way the losses produced by the engine driven oil pump 120 are less than may be the case if a larger oil pump able to satisfy a worst case situation such as engine idling at high temperature is used. The use of a smaller engine driven oil pump 120 has the effect of reducing fuel usage by the engine 110 because the engine 110 operates for most of the time in its normal operating range. For example, if the normal operating range of the engine 110 is 1500 to 3500 RPM, then the engine driven oil pump 120 is sized to better enable that, when operating within this speed range, an adequate oil flow rate and oil pressure is available irrespective of oil temperature to meet the requirements of the engine 110.

In one example the component is a cam phaser actuator and when the engine is idling with hot oil the electronic controller 200 operates the electronically controlled valve 190 to provide oil from the oil accumulator 140 to the cam phaser actuator at a pressure sufficient to operate the cam phaser actuator efficiently. At the same time the engine driven oil pump 120 may be supplying oil to bearings associated with the engine 110 via oil supply paths not forming part of the oil supply circuit. Alternatively, the oil supply demands of the engine 110 could be met from the oil supplied by the oil accumulator 140.

Another example of a situation where the oil supply from the engine driven oil pump 120 may not be sufficient to meet a current need due to the reduced size of the engine driven oil pump 120 is when the engine 110 is operating at peak torque with a high power output at low engine speed and hence a low oil pump flow rate and the oil is hot. In such a case, oil could be supplied from the oil accumulator 140 to one or more piston cooling jets while other oil demands are met by the engine driven oil pump 120 or the oil from the oil accumulator 140 could be supplied to a cam phaser actuator while other oil demands are met by the engine driven oil pump 120.

A further example of a situation where an oil demand may exist is the case of an engine of a stop-start enabled motor vehicle. In such a case, it is possible to set a demand level from the engine driven oil pump 120 to a minimum value and preferably to zero and supply the oil supply needs of the engine 110 from the oil accumulator 140 during an engine start-up. This has the advantage that the energy required by the starting apparatus to start the engine 110 is reduced to the lower load applied to the engine 110 from the engine driven oil pump 120. In addition, less wear of the starting apparatus will occur and, because the engine 110 is started by an electrical device that draws power from an electric storage device such as a battery, less fuel has to be used by the engine 110 at a later stage to recharge the battery.

Furthermore, when using an engine driven oil pump 120 the pressure varies with engine speed and so during start-up the pressure in the engine 110 is often lower than is desirable resulting in increased friction and wear. However, if the oil is supplied from the oil accumulator 140, the pressure obtainable from the moment the start-up commences is the pressure currently subsisting in the oil accumulator 140 which is likely to be close to normal engine oil pressure due to the manner in which the oil accumulator 140 is charged with oil.

The supply of oil from the oil accumulator 140 to the component 160 will continue until either there is no longer a demand for oil from the component 160 or the oil accumulator 140 is exhausted. The electronic controller 200 is able to establish when the oil supply from the oil accumulator 140 is exhausted or is about to be exhausted by using the output from the second oil pressure sensor 180 and comparing it with a predefined lower oil pressure threshold $Pa_{min}$ for the oil accumulator 140. The lower oil pressure threshold $Pa_{min}$ is set such that when the oil accumulator 140 is almost exhausted the pressure of the oil in the oil accumulator 140 will be equal to the lower oil pressure threshold $Pa_{min}$. It is important that the oil supply from the oil accumulator 140 is not totally exhausted before moving the valve member 192 to the normal operating mode (FIG. 4*a*) in which the engine driven pump 120 is connected to the component 160 because the component 160 should never be starved of oil.

Therefore in summary, by providing an oil supply system with an oil accumulator that can be charged with oil without incurring a fuel penalty and can then be subsequently discharged to make up for a shortfall in oil supply from a downsized engine driven oil pump it is possible to use an engine driven oil pump that is sized to meet normal operating needs rather than worst case needs. This has the advantage that the energy from the engine to drive the downsized engine driven oil pump is reduced thereby reducing fuel usage.

It will be appreciated that the oil supply system may include one or more oil filters and one or more oil coolers.

It will be appreciated that the engine driven oil pump could be a fixed displacement oil pump or a variable displacement oil pump.

It will be appreciated that the engine driven oil pump could be driven by any suitable means by the engine.

It will be appreciated by those skilled in the art that although the present application has been described by way of example with reference to one or more embodiments it is not limited to the disclosed embodiments and that alternative embodiments could be constructed without departing from the scope of the invention as defined by the appended claims.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first"

element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine oil supply system having an engine driven oil pump to provide a supply of oil at pressure to an oil supply circuit and an oil accumulator connectable to the oil supply circuit by means of an electronically controlled valve, an electronic controller arranged to receive an input indicative of at least one engine operating condition and to control operation of the electronically controlled valve based at least partly upon the at least one engine operating condition, a first pressure sensor to sense a pressure of oil in the oil supply circuit and supply an output indicative of the sensed pressure to the electronic controller and a second oil pressure sensor to sense a pressure of the oil in the oil accumulator and supply an output indicative of the sensed pressure to the electronic controller, wherein the electronic controller is operable to compare the output from the first pressure sensor with the output from the second pressure sensor and, if the sensed pressure of the oil in the oil accumulator is lower than the sensed pressure of the oil in the oil supply circuit and a predefined engine operating condition indicating that charging of the oil accumulator with oil will incur substantially no fuel usage by the engine is present, operate the electronically controlled valve to connect the oil accumulator to the oil supply circuit so as to charge the oil accumulator with oil at pressure, where the electronically controlled valve is formed as an integral part of an outlet from the engine driven oil pump.

2. The system as claimed in claim 1, wherein the predefined engine operating condition indicating that charging of the oil accumulator with oil will incur substantially no fuel usage by the engine is an engine shut-down condition.

3. The system as claimed in claim 1, wherein the predefined engine operating condition indicating that charging of the oil accumulator with oil will incur substantially no fuel usage by the engine is an engine over-run condition.

4. The system as claimed in claim 1, wherein the predefined engine operating condition indicating that charging of the oil accumulator with oil will incur substantially no fuel usage by the engine is an engine operating condition in which the engine is operating at a speed where excess oil would otherwise be vented to an oil reservoir.

5. The system as claimed in claim 1, wherein the first pressure sensor is located in the oil supply circuit between the outlet from the engine driven pump and the electronically controlled valve.

6. The system as claimed in claim 1, wherein the second pressure sensor is located so as to sense the pressure of the oil substantially at a take-off point where the oil is extracted from the oil supply circuit for charging the oil accumulator.

7. The system as claimed in claim 6, wherein the second pressure sensor is located at one of a position in a supply line joining the electronically controlled valve to the accumulator, an outlet from the electronically controlled valve, an inlet to the oil accumulator and a position on the oil accumulator where the oil pressure within the oil accumulator can be directly sensed.

8. A method of controlling an engine oil supply system having an engine driven oil pump to provide a supply of oil at pressure to an oil supply circuit and an oil accumulator connectable to the oil supply circuit, wherein the method comprises measuring a pressure of the oil in the oil supply circuit, measuring a pressure of the oil in the oil accumulator, comparing the pressure of the oil in the oil supply circuit to the pressure of oil in the oil accumulator and, if the measured pressure of the oil in the oil accumulator is lower than the measured pressure of the oil in the oil supply circuit and a predefined operating condition is present indicating that charging of the oil accumulator with oil will incur substantially no fuel usage by the engine, connecting the oil accumulator to the oil supply circuit so as to charge the oil accumulator with oil at pressure, wherein the predefined operating condition indicating that charging of the oil accumulator with oil will incur substantially no fuel usage by the engine is one of an engine shut-down condition and an engine over-run condition.

9. The method as claimed in claim 8, wherein the engine oil supply system includes a controllable valve to selectively connect the oil accumulator to the oil supply circuit and connecting the oil accumulator to the oil supply circuit so as to charge the oil accumulator with oil at pressure comprises opening the controllable valve to connect the oil accumulator to the oil supply circuit.

10. A method comprising:

adjusting an electronically controlled valve to a first position to connect an oil accumulator to an oil supply line in response to accumulator pressure being less than an oil supply circuit pressure; and adjusting the valve to a second position to connect the oil accumulator and an oil supply circuit which supplies oil to a component making a demand for oil in response to the accumulator pressure being greater than a predefined pressure.

11. The method of claim 10, further comprising:

adjusting the valve to a third position to connect the oil supply line and the oil supply circuit which supplies oil to the component making the demand for oil in response to the accumulator pressure being less than the oil supply circuit pressure or the predefined pressure.

12. The method of claim 10, wherein adjusting to the first position includes a condition where no fuel usage occurs.

* * * * *